US012161146B2

(12) United States Patent
McDermott et al.

(10) Patent No.: US 12,161,146 B2
(45) Date of Patent: Dec. 10, 2024

(54) SYNTHETIC FIBER ORAL FLAVORED PRODUCT

(71) Applicant: Intrepid Brands LLC, Louisville, KY (US)

(72) Inventors: Brendan McDermott, Santa Monica, CA (US); Charles Melander, Louisville, KY (US); John Morrison, Louisville, KY (US); Gregory Hoffman, Louisville, KY (US); Rob Riesel, Louisville, KY (US)

( * ) Notice: Subject to any disclaimer, the term of this patent is extended or adjusted under 35 U.S.C. 154(b) by 447 days.

(21) Appl. No.: 17/178,108

(22) Filed: Feb. 17, 2021

(65) Prior Publication Data

US 2021/0251277 A1 Aug. 19, 2021

Related U.S. Application Data

(60) Provisional application No. 62/978,125, filed on Feb. 18, 2020.

(51) Int. Cl.

| | |
|---|---|
| ***A24B 15/16*** | (2020.01) |
| ***A24B 13/00*** | (2006.01) |
| ***A24B 15/18*** | (2006.01) |

(52) U.S. Cl.

CPC ..... *A24B 15/16* (2013.01); *A24B 13/00* (2013.01); *A24B 15/18* (2013.01)

(58) Field of Classification Search

CPC ..... A24B 15/10; A24B 15/16; A24B 13/00; A24B 15/18

See application file for complete search history.

(56) References Cited

U.S. PATENT DOCUMENTS

| | | | | |
|---|---|---|---|---|
| 5,144,967 | A * | 9/1992 | Cartwright | A24B 15/282 131/365 |
| 9,185,931 | B2 | 11/2015 | Gao et al. | |
| 9,420,827 | B2 | 8/2016 | Mishra et al. | |
| 9,521,864 | B2 | 12/2016 | Gao et al. | |
| 10,183,016 | B2 | 1/2019 | Gao et al. | |
| 10,349,672 | B2 | 7/2019 | Gao et al. | |
| 2003/0159702 | A1* | 8/2003 | Lindell | A61K 31/465 514/343 |
| 2005/0260264 | A1 | 11/2005 | Edgren et al. | |
| 2013/0199553 | A1* | 8/2013 | Elliott | A01H 1/04 800/317.3 |
| 2014/0332013 | A1* | 11/2014 | Gao | A61K 9/2013 131/111 |
| 2016/0354360 | A1 | 12/2016 | Gao et al. | |
| 2021/0169788 | A1 | 6/2021 | Mua et al. | |

* cited by examiner

*Primary Examiner* — Dennis R Cordray

(74) *Attorney, Agent, or Firm* — Stites & Harbison, PLLC; Terry L. Wright

(57) ABSTRACT

An synthetic fiber oral flavored product includes a fibrous substrate. The fibrous substrate is made of a synthetic polyester in a typically pelletized shape imbued a carrier liquid of propylene glycol or equivalent. The carrier liquid carries a freebase synthetic nicotine, a binding agent, a textural adjustment agent and flavorants. In some examples, the fibrous substrate is heat treated and modified by heating and rapid cooling the substrate to increase the zeta potential of the fibrous substrate.

18 Claims, 2 Drawing Sheets

SYNTHETIC FIBER ORAL FLAVORED PRODUCT

FIELD OF THE DISCLOSURE

The present description relates generally to an oral product delivering nicotine or other active ingredients for sublabial or oral uptake.

BACKGROUND OF RELATED ART

Herbal materials, like tobacco and hemp among others, have been enjoyed by humanity since time immemorial. Peoples of the modern-day U.S. and Mexico, have utilized these materials for ritual as well as recreational use dating back thousands of years. Product shapes and delivery methods have changed with the times, but humanity has a continual desire for creative and easy to use herbal products.

U.S. Pat. No. 9,521,864 shows "a cellulosic fiber-nicotine mixture can be combined with one or more binders and molded into an oral product".

U.S. Pat. No. 8,586,819 shows an "[a]bsorbent pods comprise a pouch formed of a porous material. The pouch contains an absorbent polymer in an amount sufficient to absorb at least about 20 mL of fluid."

DETAILED DESCRIPTION

The following description of example methods and apparatus is not intended to limit the scope of the description to the precise form or forms detailed herein. Instead the following description is intended to be illustrative so that others may follow its teachings.

Traditionally chewing tobacco, snuff, or snus is used to provide smoke-free nicotine dosages. Nicotine pouches are a common oral nicotine solution, but flavor and nicotine experience/dose is predetermined to the customer from the manufacturer. The present oral product allows users to chose the amount they would like to use, in some examples, right down to the individual fiber.

The present oral product presents a 1) a tobacco-less and combustion-less nicotine experience and 2) a malleable, adjustable and chosen portion experience that is long lasting and clean in appearance. In use, the oral product is placed under the lip and delivers micro-encapsulated active ingredients for uptake through saliva either sublabial, buccal, or sub-lingually. A variety of active ingredients are considered, but primarily nicotine is discussed herein.

The instant oral product solution has no combustion. The oral product can be customizable to the needs and desires of the user, unlike traditional oral pouch products, particularly, nicotine products. The present disclosure is not limited to nicotine as the methods of this disclosure can be implemented on any legal active ingredient. By utilizing a varying amount of the product, the nicotine level, or more generally, an amount can be gauged to the end consumer's desires. The present oral product also adjustable in a user's lip and malleable for optimal comfort.

At present, nicotine pouches are a common oral nicotine solution, but flavor and nicotine experience/dose is predetermined to the customer from the manufacturer. The present disclosure allows users to choose the amount they would like to use, in some examples, right down to the individual piece of substrate, like a fiber or knot of fibers. The present oral product can also selectively limit ingredients, allowing flavorings or actives to be presented to the end user individually. This gives a user/consumer the option to extinguish bad breath or to simply have a preferred taste in their mouth, like a mint, flavored gum or lozenge with less waste or calories.

Figure 1:
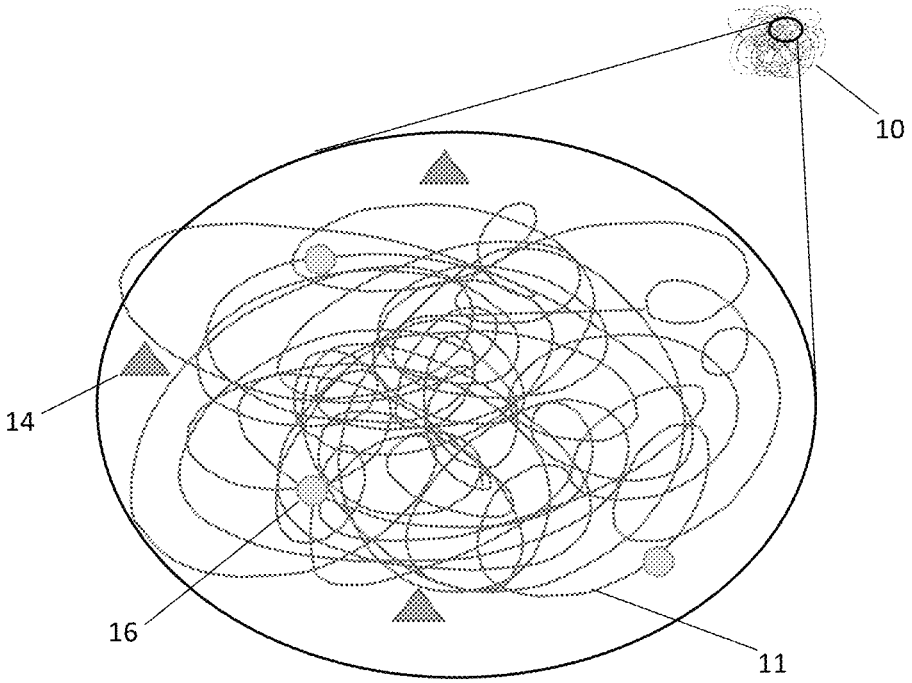
FIG. 1 is a diagram of an unrestrained fiber variant of the oral product according to the teachings of the present disclosure.

Referring now to FIG. 1, the oral product 10 is shown with a detailed view showing the micro-encapsulated active ingredients. The present oral product consists of a primary substrate, a carrier liquid including at least flavorings and an active ingredient. The detailed view shows the microencapsulated active ingredient obtained through the process discussed in further detail with respect to FIG. 3, further below. The primary substrate can be formed or remain in a natural form similar to a ball. In other examples, the oral product could have a form factor: loose fiber, pellets, roll, sponge, woven fiber, ball, granular, foam, dry ball, filled pellet.

In the example shown, the primary substrate is chopped up, blended or pulled apart cotton. In other examples, synthetic cotton, polyester fibers, or other suitable material are considered. In the example shown in FIG. 1, the primary substrate 12 is a natural fiber cotton in a ball form. The ball form of the present oral product is visually appealing and comfortable in use. In another example, if the primary substrate is a fiber it can also be woven into a fabric. A fabric substrate can be rolled in some examples for more compact packaging. In some examples, the substrate fabric can be manufactured in a continuous process and any carrier liquid can be applied to increased consistency and, with a high, controllable accuracy depending on manufacturing methods.

Figure 2:
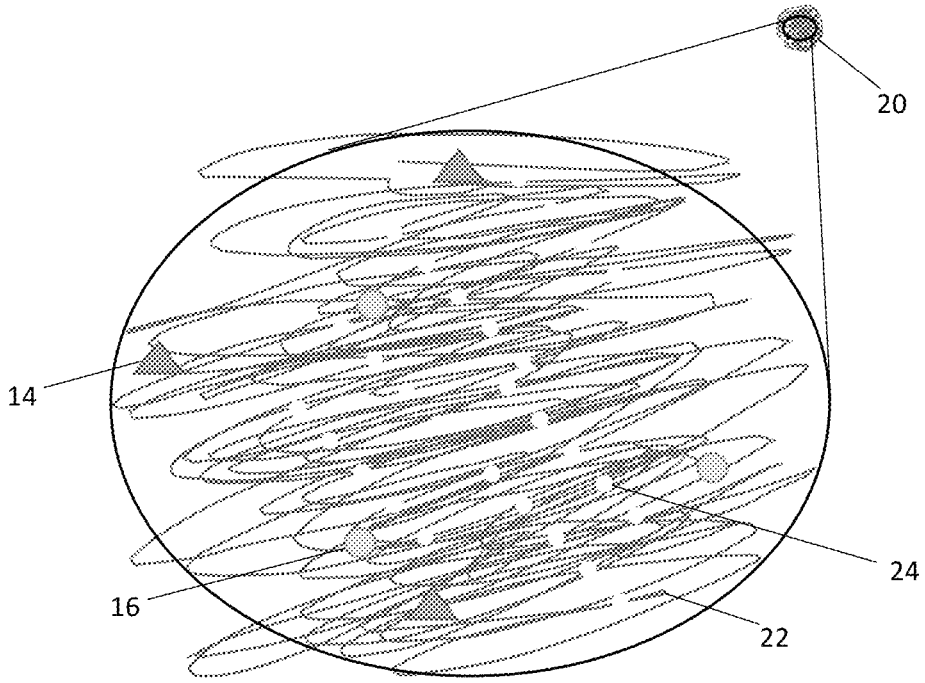
FIG. 2 is a diagram of a pelleted variant of the oral product according to the teachings of the present disclosure.

Another example of the present disclosure is shown in FIG. 2. In this example, the substrate is a pelletized synthetic fiber. In other examples of the oral product 10, the substrate can be pelletized or otherwise more densely packed. In the example shown in FIG. 2, the pellet 20 can be formed from polyester strands or fibers. Other synthetic fibers considered here include polypropylene, polyethylene, kevlar, rayons, synthetic fibers, acrylic, spandex, nylon, elastane, polyolefin, or other similar synthetic polymers. Synthetic fibers also present advantages in selecting strength, durability, resiliency and flexibility allowing the practitioner to adjust the sensation (mouthfeel) and compression when the oral product is placed in the end-user's mouth. Certain synthetic materials also present advantages in non-toxicity, lack of reactivity, and UV resistance.

Polyester is used in this example shown in FIG. 2 for its non-toxicity and thermoplasticity. The nature of the material allows for cross linking among the polyester fibers in this example can be used to increase pellet resiliency or adjust mouthfeel. When compared to a natural fiber, the polyester is cleaner and less likely to grow organisms and is non-toxic if accidental swallowed by the end user.

As shown in the detail view in FIG. 2, the individual fibers 22 of pellet 24 of the substrate 12 have a series of individual pores 24. Because the fibers 22 in the example oral product shown in FIG. 2 are a synthetic polymer, particularly, polyester, little to no absorption of the active ingredient 14 takes place. Absorption of the active ingredient 14 would be entry of the active ingredient into the interstitial space within the substrate. Adsorption is a weak bonding of to the surface by Van Der Walls forces. The electrokinetic potential of a surface is measured by its zeta potential which varies by pH. Zeta potential of the substrate can be varied by ionization of the ingredients in the fluid and modifications to the surface. While many synthetic fibers are relatively inert chemically, potential modifications of the substrate are still available include heating and cooling the material at varying rate, oxidization of polydopamine and other similar surface coatings, subjecting the substrate to high or low pressures, plasma treatments, or other similar polymer modification treatments. Additionally, inclusions and additives, like carbon or silicon, can be added to the substrate before it is formed into fibers to increase resilience, fiber strength, or other properties. In some cases, these additives may be temporary melting out of the substrate to provide internal or external porosity or otherwise vary surface texture. Because adsorption requires a surface to cling to, total surface area is critical for adsorption of the active ingredients 14 onto the substrate 12 in this example. The pores 24 further increase the surface area of the fibers 22. The densely packed pellet substrate 12 formed by fibers 22 increases surface area and adsorption capacity.

Fiber packing density inhibits fluid flow within the pellet 20. While this leads to some difficulties in the speed of loading the pellet 20 with an active ingredient 14, it has offsetting advantages in extending and controlling release of the active ingredient 14. Because the user's saliva cannot flow freely into the core of the pellet 20 in certain examples, slow release of the active ingredient 14 can achieved by altering the density and proximity of the fibers 22. Certain thermoplastic polymers present other advantages in this regard because they can be formed and reformed using carefully directed heat.

Active ingredient 14 is shown in FIGS. 1-2 in the detail views of the respective figure. In FIG. 1, the active ingredient 14 is a microencapsulated nicotine compound. In FIG. 2, the active ingredient 14 is a synthetic freebase nicotine solution.

Other alternative active ingredients 14 could include any type of nicotine whether it is synthetic or tobacco derived, a nicotine salt, disassociate freebase nicotine, or nicotine polacrilex or the like. Other herbal or synthetic products Cannabinoid and cannabinoid extracts, caffeine, melatonin, cytosine, kava, and kratom (*Mitragyna speciosa*) if legal in the local jurisdiction. Other examples could dietary and nutritional supplements for update either sublabially or through the digestive system, for example, the active ingredients 14 could include mineral, amino acids, vitamins (A, C, D, B12) or similar compounds. In yet further examples, the active ingredient could be terpenoids, oils or other extracts of plant matter, such as hemp, tobacco, Goldenrod Herb *Lobelia* (*Lobelia Inflata*). In some examples, the product can be adapted to include prescription or over the counter ingredients, that when used as directed by a physician, can allow the user to tailor their intake to their needs. Examples of potential uses could include antidepressants such bupropion or smoking cessation products such as varenicline. Similar uses could include over the counter numbing agents or other topical painkillers for mouth or tooth pain, treating a sore throat.

Referring back to FIG. 1, other additives 16 such as flavorings and binders can be added to the oral product 10 to tailor the product to their specific customers. For example, certain forms of nicotine adds metallic taste and flavors such as citrus can be selected to balance flavor of that active ingredient 14. Depending on the choice of active ingredient 14, water or other solvents are used to thin active ingredients and spread them evenly across the substrate. Examples of non-water based solvents include vegetable glycerin and propylene glycol. The solvent in a specific example is selected based its ability to dissolve the active ingredient 14 or any other solids, being added to the product in that example.

These ingredients in the oral product 10 will need to be to liquid or ground to a sufficiently small size to avoid disrupting the intended texture of the oral product 10. In most examples, the oral product 10 is intended to be soft and resilient, fitting comfortably next to the user's gums. In some cases, the active ingredients 14 or other additives 16 will have a texture that interferes with the desired textures. To correct this, other additives 16 may also include a binding agents or texture adjusters. In many cases, no changes to the substrate would have to be made, instead binding agents can be selected to help aid in bonding the active ingredient 14 to the substrate 12. Binding agents can also include smoothing agents, such as gum acacia to adjust the harshness of taste or texture. The carrier liquid 18 can also function as a thinning agent. Thinning agents may include vegetable glycerin, propylene glycol, water, coconut oil, or similar materials.

These binding agents can also be used to modify the flavor release pattern of the active ingredients 14, by for example, thickening the carrier solution. The active ingredient 14 is more tightly or more strongly bound in solution or directly to the substrate 10. and requires more time to release into saliva. Other options can include microencapsulates (as discussed in further detail below) which can serve similar purpose. Other texture adjustments may include additional solvents or moisture to thin the solution or accelerate flavor release.

Depending on the active ingredient, the pH of the solution may need to be altered for chemical stability, on the shelf, or bioavailability, in the mouth, for example. As this product is meant for oral use, the effect on pH levels of saliva must be considered as well. For example, nicotine is a weak base and user uptake of nicotine is highly dependent on pH level. Examples of pH control agents that can be included as other additives 16 include sodium hydroxide, potassium carbonate, calcium carbonate, sodium bicarbonate, and other carbonates, and similar food-grade acidic and alkaline substances to alter the pH of the product and product-salvia mixture.

The oral product 10 can include any number of flavorings and sweeteners as other additives 16 to craft the user's unique flavor for marketability, product differentiation, and overall taste. As with other additives 16, flavorings can be powdered, liquid or suspended in solution. Flavorings can include terpenes (natural or synthetic), extracts, concentrates, organic acids, flavor enhancers, salt, and any other similar material. In other examples, sweeteners are added as or in addition to flavorings. Some sweeteners can also work as binding agents and textural adjustment agents. For example, sweeteners could include polydextrose, honey, syrups, simple & complex sugars, polysaccharides, sorbitol, sugar alcohols, and other similar sweet tasting compounds.

In certain examples, the other additives 16 are mixed with the carrier liquid 18. In other examples, the other additives 16 can be applied on as a powder coating. This allows large insoluable solids to be applied that may not be miscible in the carrier liquid 18. Other ingredients may be simpler, cheaper or safe to apply as a solid. In some cases, like sweeteners or flavors this occurs as a final step, it is advantageous to the user experience for the first taste to be sweeter or more flavorful. By putting the other additives 16 on the outside faces of the substrate 12, the initial experience can be calibrated.

In some examples, like that shown in FIGS. 1-2, the oral product includes carrier liquid 18. Carrier liquid 18 aids in loading the product, suffusing the product with active ingredients 14 and other additives 16 during the manufacturing process. Carrier liquids 18 can also aid in distribution of the active ingredient 14 into the end user's saliva. Carrier liquids 18 can include water, propylene glycol, vegetable glycerin, oils such as coconut oil or MCT oil or other similar carriers. In other examples, the carrier liquid 18 is removed or dried, for example by heating. In these examples, the dry substrate is a solid crystaline substance, when the oral product encounters the end user's saliva which re-adds the primary source of water. As there is no solution, the active ingredients or other additives only need to be adapted to the saliva dissolution environment, particularly the pH of the resultant saliva mixture.

Figure 3:
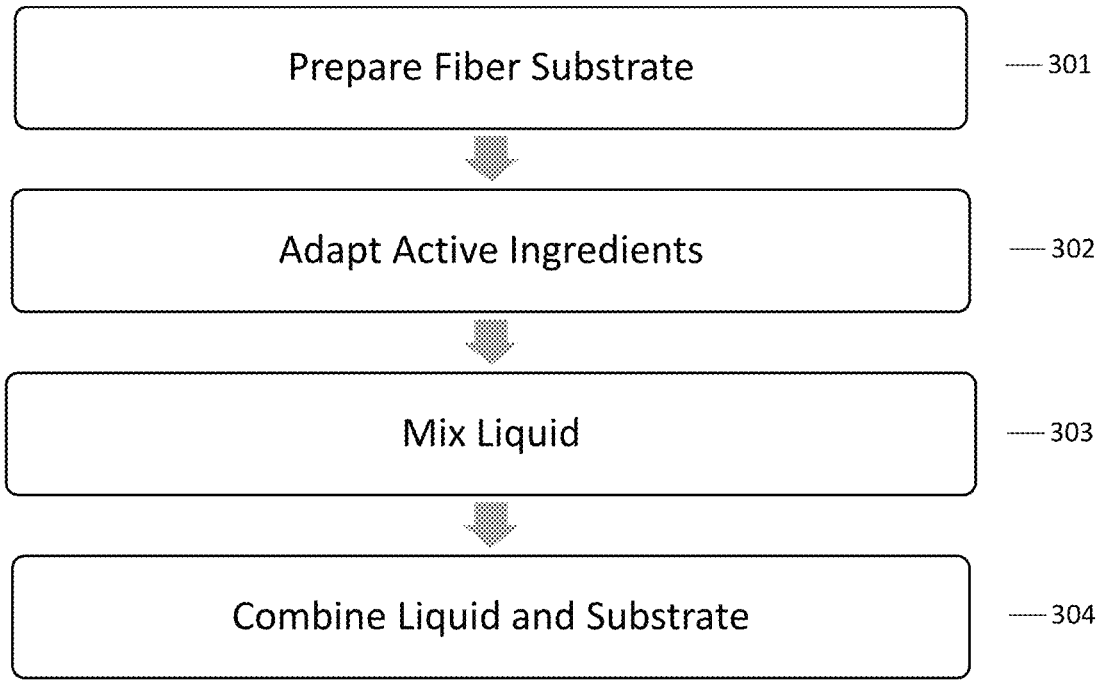
FIG. 3 is a flowchart showing the method of developing the oral product according to the teachings of the present disclosure.

Referring now to FIG. 3, an example of the process of creating an example oral product is shown. At step 301, a fiber substrate is prepared as discussed above. At step 302, the active ingredients are adapted for the specific example discussed herein. In some examples encapsulated before being manufactured into the oral product. At step 303, the active ingredients are mixed with flavorings into a carrier liquid. The carrier liquid is mixed with the active ingredient, nicotine. This solution is blended and applied to the fiber. It can be applied through dropping on the fibers, squirting on the fibers, spraying on the fibers or dunking the fibers into solution. Flavorings could be from a number of natural and artificial sources to create any number of flavors attractive to adult consumers. Sweeteners may also be added to the carrier liquid. At step 304, the liquids are installed onto the substrate, coating it. The microencapsulated active ingredient is not absorbed into the fiber due to the micelle boundary layer.

Figure 4:
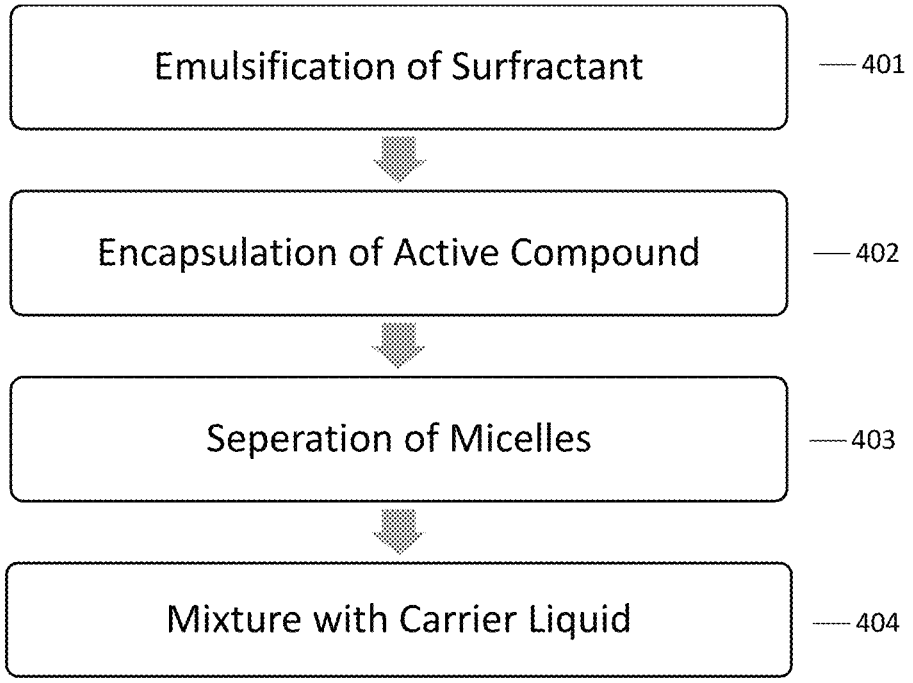
FIG. 4 is a flowchart showing the method of developing the contained active ingredient according to the teachings of the present disclosure.

In another example, the oral product may include encapsulated ingredients. Referring to FIG. 3 at step 302, the active ingredients in this example are encapsulated as shown in further detail in the process shown in FIG. 4. The microencapsulation process, detailed in FIG. 4, utilizes a surfactant to form micelles around the active compound. The surfactant must be selected with complementary bonds to the active compound on a first bonding site and complementary bonds to a target solution on the other in order to form a micelle. In the example shown, the active compound is nicotine, a hydrophilic molecule, or tobacco free nicotine (TFN) and the target solution is propylene glycol and/or vegetable glycerin, a hydrophobe.

In this example, a ratio of 10 g cetyl alcohol as surfactant to 1 g nicotine is used. At step 401, emulsification is achieved in this example by agitation of the surfactant in solution above the melting point of the surfactant. the active compound. At step 402, in this example, the active compound is added and fully mixed in. At step 403, the solution is dried and ground separating the micelles. The extracted micelles can then be added to the carrier liquid, a hydrophobic solution at step 404. The micelle retains its shape in the carrier liquid.

The present oral product in one example is packaged in a cylindrical can. In other examples, the present oral product is packaged in a semipermeable bag, or a novelty shaped container. The packaging for the oral product must be adapted to the evaporation rates of the product, particularly the carrier liquid 18. As discussed above, the oral product 10 can be a moist product and the packaging can control this loss of moisture. In some examples the packaging may include sources of moisture to control the interior environment.

The packaging of the present oral product can be critical for safety and attendant regulatory compliance. In some examples of the present oral product, the can includes child proof opening protections, requiring the user to use two action simultaneously to unseal the container, for example, push and turn at the same time to open the can. In other examples, the lid or opening for the oral product can include tamper-proofing such as breakable portions that can show the product has been previously opened.

Other containers of the presently discussed oral product may include dispensing solutions to aid or limit the user in portioning out the amount of oral product desired at a given time. In some examples, the example packaging or container can include a feeding or funneling mechanism to limit the amount of oral product released from the container at one time. For example, a chute could be sized to the pellet as in the example shown in FIG. 2 and a rotational structure could prevent multiple pellets from being dispensed simultaneously. The structure could, for example, be manually actuated with a switch. In some examples, the container could be formed to such that shaking the product container in certain orientations, such that the oral product 10 is dispensed by shaking the product, for example, upside down. Depending on the form of substrate 12, the container could dispense the product by rolling or unwinding the product and then this example product includes tearing or cutting means integrated into the container. In an example like this, tearing or cutting means could be used in certainly examples to aid the user in selecting, portioning, cutting, and serving the end user's desired amount of oral product.

The microencapsulated nicotine allows for control of the dosing of the product, yielding a slower release of the active ingredient. Because the user's saliva needs to break down the bonds between the lipid walls of the micelle, the nicotine for example is released more slowly producing a product that lasts longer.

The present oral product offers a solution that is both long lasting and clean in appearance. Other oral products such as nicotine pouches presently available nicotine solutions do not offer a customer both of the following, 1) a tobacco-less and combustion-less nicotine experience and 2) a malleable, adjustable, and portion chosen experience.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

REFERENCED ELEMENTS oral product 10
substrate 12
active ingredient 14
other additives 16
carrier liquid 18
pellet 20
fibers 22
pores 24.

We claim:

1. An oral product comprising:

a carrier liquid including an active ingredient; and a plurality of synthetic polymer fibers, the carrier liquid blended with and applied to the plurality of synthetic polymer fibers such that the active ingredient is sorbed onto the plurality of synthetic polymer fibers and is present as part of a liquid component distributed throughout the oral product, and such that the oral product is a moist product.

2. The composition of claim 1, wherein the active ingredient is nicotine.

3. The composition of claim 1, wherein the synthetic polymer is polyester.

4. The composition of claim 1, wherein the plurality of synthetic polymer fibers is in one of the following forms: loose fibers, pellets, roll, sponge, woven fibers, ball, granular, or foam.

5. An oral product comprising:

a fibrous substrate made of a synthetic polymer, and a carrier liquid comprising an active ingredient, binding agent, and flavorant, the carrier liquid blended with and applied to the fibrous substrate such that active ingredient is present as part of a liquid component distributed throughout the fibrous substrate and such that the oral product is a moist product.

6. The oral product of claim 5 wherein the active ingredient is nicotine.

7. The oral product of claim 5 wherein the synthetic polymer is polyester.

8. The oral product of claim 5 wherein the synthetic polymer is in one of the following forms: loose fiber, roll, sponge, woven fiber, ball, granular, or foam.

9. The oral product of claim 7 wherein the polyester makes up a substrate that is pelletized.

10. The oral product of claim 9 where the substrate is heat treated.

11. The oral product of claim 5 wherein the carrier liquid is includes at least one of vegetable glycerin, propylene glycol, water, or coconut oil.

12. The oral product of claim 5 further comprising a textural adjustment agent.

13. The oral product of claim 5 wherein the binder is also a textural adjustment agent.

14. The oral product of claim 13 wherein the binder is gum acacia.

15. The oral product of claim 5 wherein the binder is selected to increase adsorbtion of the active ingredient onto the fibrous substrate.

16. The oral product of claim 5 wherein the substrate is modified to increase a zeta potential.

17. The oral product of claim 16 wherein the substrate is modified to increase the zeta potential by means of at least one of the following: heating and cooling the material at varying rates, oxidization of polydopamine and other similar surface coatings, subjecting the substrate to high or low pressures, plasma treatments.

18. An oral product comprising:

a fibrous substrate made of a plurality of synthetic polyester fibers in a pelletized shape, a carrier liquid comprising propylene glycol, nicotine, a binding agent, a textural adjustment agent, and flavorants, the carrier liquid blended with and applied to the fibrous substrate such that the nicotine is present as part of a liquid component distributed throughout the fibrous substrate and such that the oral product is a moist product, wherein the fibrous substrate is heat treated and modified by heating and rapid cooling the substrate to increase a zeta potential of the fibrous substrate.

* * * * *